US008992291B2

(12) United States Patent
Meyer

(10) Patent No.: US 8,992,291 B2
(45) Date of Patent: Mar. 31, 2015

(54) COIN SORTER

(71) Applicant: Crane Payment Solutions GmbH, Buxtehude (DE)

(72) Inventor: Wilfried Meyer, Buxtehude (DE)

(73) Assignee: Crane Payment Solutions GmbH, Buxtehude (DE)

( * ) Notice: Subject to any disclaimer, the term of this patent is extended or adjusted under 35 U.S.C. 154(b) by 0 days.

(21) Appl. No.: 14/052,281

(22) Filed: Oct. 11, 2013

(65) Prior Publication Data

US 2014/0106655 A1 Apr. 17, 2014

(30) Foreign Application Priority Data

Oct. 15, 2012 (DE) ..... 10 2012 020 154

(51) Int. Cl.

| | |
|---|---|
| ***G07D 3/00*** | (2006.01) |
| ***G07D 3/02*** | (2006.01) |
| ***G07D 3/14*** | (2006.01) |
| ***G07D 9/00*** | (2006.01) |

(52) U.S. Cl.

CPC .. *G07D 3/00* (2013.01); *G07D 3/02* (2013.01); *G07D 3/14* (2013.01); *G07D 9/008* (2013.01)

USPC ..... 453/3

(58) Field of Classification Search

CPC ..... G07D 3/00; G07D 3/14; G07F 3/00; G07F 3/04

USPC ..... 453/3, 9–11, 6, 7, 56; 194/342, 343, 194/344

See application file for complete search history.

(56) References Cited

U.S. PATENT DOCUMENTS

| | | | | |
|---|---|---|---|---|
| 4,167,949 | A * | 9/1979 | Hashimoto et al. | 453/12 |
| 4,172,462 | A * | 10/1979 | Uchida et al. | 453/6 |
| 5,135,433 | A * | 8/1992 | Watanabe et al. | 453/3 |
| 5,207,611 | A | 5/1993 | Ueda et al. | |
| 7,861,841 | B2 * | 1/2011 | Nagase et al. | 194/200 |
| 2002/0144878 | A1 * | 10/2002 | Zimmermann et al. | 194/331 |
| 2003/0024791 | A1 | 2/2003 | Kurosawa et al. | |

FOREIGN PATENT DOCUMENTS

| | | | |
|---|---|---|---|
| DE | 27 54 792 | A1 | 6/1978 |
| DE | 41 23 549 | A1 | 1/1992 |

* cited by examiner

*Primary Examiner* — Mark Beauchaine

(74) *Attorney, Agent, or Firm* — Vidas, Arrett & Steinkraus

(57) ABSTRACT

A coin sorting device comprising a housing and a first rotary disc in the housing and rotatingly drivable by a rotary drive for receiving coins to be sorted with different diameters, the first rotary disc is surrounded by a guide wall and a coin discharge area delimited by a wall section, coins on the first rotary disc arrive at a coin conveyor track connecting to the coin discharge area, a conveying device is provided for conveying coins, wherein the coin conveyor track is delimited by a guide edge, and wherein at least one opening is provided to the coin discharge area and/or along and/or next to the coin discharge track, through which the coins travel to an area below the first rotary disc, at least one additional rotary disc rotatingly drivable by a rotary drive is arranged below the first rotary disc.

18 Claims, 2 Drawing Sheets

COIN SORTER

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a coin sorting device, comprising a housing and a first rotary disc arranged in the housing and rotatingly drivable by means of a rotary drive for receiving a plurality of coins to be sorted with different diameters, wherein the first rotary disc is surrounded at least in sections by a guide wall and wherein a coin discharge area delimited by a wall section is provided, through which coins located on the rotatingly driven first rotary disc arrive at a coin conveyor track connecting to the coin discharge area, wherein a conveying device is provided for conveying the coins along the coin conveyor track, wherein the coin conveyor track is delimited by a guide edge on its inside and/or its outside, along which the coins are conveyed by the conveying device, and wherein at least one opening is provided in and/or next to the coin discharge area and/or along and/or next to the coin discharge track, through which the coins can make their way to an area below the first rotary disc.

Such a coin sorting device is normally also called a coin recycler. The coin sorting device has a coin intake, via which a plurality of unsorted coins can be supplied individually or together. From the coin intake, the coins make their way to the rotatingly driven rotary disc, which forms a so-called centrifuge. From the rotatingly driven rotary disk, the coins make their way under a conveying device and into a coin discharge area. The conveying device conveys the coins out of the coin discharge area along a coin conveyor track. Different areas are provided along the coin conveyor track, for example a coin check area and a coin sorting area.

In the case of such coin sorting devices, there is generally a need to keep the structure as compact as possible. Among other things due restrictions regarding installation space, it cannot always be ensured that for example the coin return assigned to an opening or respectively the coin storage unit assigned to an opening is arranged below the respective opening such that the coins can be directed for example by gravity into the coin return or the coin storage unit.

BACKGROUND OF THE INVENTION

Based on the explained state of the art, an object of the invention is to provide a coin sorting device of the initially named type, which has a compact structure and a secure sorting function.

The invention solves the object through a coin sorting device, comprising a housing and a first rotary disc arranged in the housing and rotatingly drivable by means of a rotary drive for receiving a plurality of coins to be sorted with different diameters, wherein the first rotary disc is surrounded at least in sections by a guide wall and wherein a coin discharge area delimited by a wall section is provided, through which coins located on the rotatingly driven first rotary disc arrive at a coin conveyor track connecting to the coin discharge area, wherein a conveying device is provided for conveying the coins along the coin conveyor track, wherein the coin conveyor track is delimited by a guide edge on its inside and/or its outside, along which the coins are conveyed by the conveying device, and wherein at least one opening is provided in and/or next to the coin discharge area and/or along and/or next to the coin discharge track, through which the coins can make their way to an area below the first rotary disc, wherein at least one additional rotary disc rotatingly drivable by means of a rotary drive is arranged in at least one plane below the first rotary disc, which is designed to convey coins to at least one coin return and/or to at least one coin storage unit.

As initially mentioned, the coin sorting device is a so-called coin recycler. One can generally divide such coin recyclers into two modules. A lower module of the coin recycler is formed by a coin storage unit and a coin payout module to the customer. This module normally comprises so-called hoppers, which can save and output coins. The hoppers normally have a payout disc and a container for coins. The paid out coins can then be transported for example through a transport belt or the like into a return or output dish. Here, the customer can receive the appropriate change. If necessary, this lower module can also comprise a coin register.

The upper module of the coin recycler is responsible for receiving the coins. In a money transaction or for example in a coin filling, coins are received, measured and sorted according to their value by the upper module. Foreign bodies, liquids or incorrect money should be rejected and real money should be sorted into the provided coin storage unit.

The invention concerns in particular such an upper module of a coin recycler. As mentioned above, coins are inserted individually or in larger amounts (as so-called bulk) into the coin sorting device through a coin inlet of the coin sorting device, where they make their way to the rotatingly driven rotary disc. The coin inlet area can be formed for example by an intake hopper. The rotating rotary disc working as a centrifuge moves the coins in succession to the conveying device in the coin discharge area.

The rotatingly driven rotary disc can be designed circularly, for example annularly. The coin conveyor track and the conveying device can also run circularly. In a generally known manner, at least one coin check area and at least one coin sorting area can be provided in the conveying direction of the coins subsequent to the coin discharge area along the coin conveyor track with the discharge hole. The coin check area can comprise one or more detectors for checking the passing coins. The coin sorting area can comprise e.g. a passive or active sorting of the coins, for example by means of several successively larger sorting holes arranged one after the other in the conveying direction of the coins.

In the case of the invention, at least one additional rotary disc rotatingly drivable by means of a rotary drive is arranged in at least one plane below the first rotary disc. A conveying device can thereby be provided, which is designed to guide the coins that made their way through the at least one opening to the at least one additional rotary disc. The coins guided through the conveying device of the coin sorting device to the at least one additional rotary disc are then conveyed through the at least one additional rotary disc to at least one coin return and/or to at least one coin storage unit.

The at least one coin return and/or the at least one coin storage unit can be part of the coin sorting device according to the invention. They can form any return or storage container. Coin returns can form for example a return to a customer or to a cash register. Coin storage units can be provided for long-term storage, in particular until a manual or operative emptying of the storage unit. But they can also be sorting storage units for coins, from which coins are then paid out in further payment transactions. The coin storage units can thus be so-called coin tubes, into which the coins are sorted depending on their size, in particular their diameter or respectively their value.

According to the invention, a "stacked" arrangement of rotary discs forming centrifuges is thus provided. With the at least one additional rotary disc below the first rotary disc, coins that made their way through the at least one opening can be fed to coin returns or respectively coin storage units at almost any location in the coin sorting device in a constructively particularly compact manner. It is thus not required that the coin return assigned to an opening or respectively the coin storage unit assigned to an opening is located vertically or mainly vertically below the respective opening. Thus, in the case of a compact structure of the coin sorting device, great flexibility is achieved with respect to the arrangement of the openings on one hand and the coin returns and coin storage units on the other hand and thus with respect to the sorting procedure.

According to one embodiment, the rotary disc can have a circular middle part elevated by an annular disc area and with respect to the bottom of the annular disc area, wherein the middle part is also rotatingly drivable or fixed. The middle part can be rotatingly driven by the same rotary drive as the annular disc area or independently of it. However, it can also be designed fixed. Coins located on the rotatingly driven rotary disc hit the elevated middle part in the course of their conveyance through the rotary disc so that the middle part conveys the coins e.g. together with a wall section of the coin discharge area to the conveying device and thus out of the rotary disc. For this, the coin discharge area can be designed wedge-shaped at least in sections, wherein a wall of this wedge can be formed by the conveying device, for example an inner flank of a conveyor belt and the other by the middle part of the rotary disc. A coin reaching this wedge-shaped coin discharge area is then captured by the conveying device, for example an inner flank of a conveyor belt, and pushed against the opposite-lying side of the middle part of the rotary disc. On the middle part, the coin then rolls off, wherein it is pushed further to the conveying device, in particular under a conveyor belt, as a result of the tapering wedge. In order to prevent two or more coins lying on top of each other from thereby getting pushed under the conveyor belt, the height of the middle part relative to the bottom of the annular disc area of the rotary disc can be restricted to a height that is lower than the thinnest coin to be sorted. In the generally known manner, the at least one opening can be a hole, into which the coins can fall, in particular due to gravity.

Several openings can be provided, wherein the openings are provided respectively for coins with different diameters and/or different types or respectively values. A sorting of the coins can thus take place depending on their size, in particular on their diameter, or respectively their value. The several openings can be arranged behind each other in the conveying direction of the coins along the coin conveying track. The openings can have different sizes. In this manner, a generally known passive sorting is possible, in which the openings are designed as simple holes. In the conveying direction of the coins along the conveying track, the openings are larger so that the coins automatically fall into the respectively fitting opening depending on their diameter, namely the smallest coins first and then successively the larger coins.

It is also possible that at least one sensor device is provided, by means of which the diameter and/or the type of the coins can be determined, and that at least one actuating device is provided, with which the coins can be directed into one of the openings depending on their diameter and/or their type. The at least one opening can be closed by a flap in an idle state. The actuating device can then be designed to move the flap(s) of the opening(s) in a targeted manner into an open state in order to thus direct the coins into one of the openings depending on their diameter and/or their type. The actuating device can also comprise an actuating element, for example an actuating pin, through the actuation of which coins can be directed into one of the openings depending on their diameter and/or their type. For example, it is also possible that the coins are diverted out of their track by the actuating element, for example an actuating pin, such that they fall into one of the openings. The coins can thus be pushed by the actuating element, for example the actuating pin, for example off the coin conveyor track into openings arranged next to the coin conveyor track, in particular holes, or directed into one of the openings through another deflection. In the case of these different and practical embodiments, an active sorting of the coins takes place as a rule based on measurement results from suitable sensors, as is known to a person skilled in the art.

According to a further embodiment, it can be provided that several additional rotary discs rotatingly drivable by means of a rotary drive are arranged in different planes below the first rotary disc, wherein the additional rotary discs are designed to convey the coins to different coin returns and/or different coin storage units, and wherein the conveying device is designed to guide the coins to one of the additional rotary discs depending on the opening, through which it passes. Thus, in the case of this embodiment, several stacked rotary discs are provided below the first rotary disc in different planes. Depending on their diameter or respectively their type, the coins falling through the openings are fed to one of these additional rotary discs under the first rotary disc, which then sorts them into the respective fitting coin return or respectively the respective fitting coin storage unit. The coins are fed through the different rotary discs to different coin returns or coin storage units. It is thereby possible that only one coin type is fed to each of the additional rotary discs for further sorting. Each rotary disc can then be connected for example with only one coin return and/or only one coin storage unit for the respective coin type. But it is also conceivable to feed several different coin types to one or more of the additional rotary discs for further sorting. For example, a first coin type could be fed to a first section, in particular a first half, of the rotary disc and a second different coin type could be fed to a second section, in particular a second half of the rotary disc. The different sections, in particular the two halves, of the rotary disc would then be connected with different coin returns and/or different coin storage units for the different coins, to which they guide the different coins.

Generally, all rotary discs or some of the rotary discs of the coin sorting device according to the invention can be rotatingly driven by the same rotary drive. But it is also possible that individual or all rotary discs are rotatingly driven by individual rotary drives. For example, the first rotary disc can be driven faster than the one or several additional rotary discs. This can be ensured through different rotary drives or in the case of a joint drive through a suitable gearbox.

The conveying device can comprise one or more conveyor tracks for the coins. The conveying device can also comprise one or more conveyor belts for the coins. The coins falling through the openings can be fed e.g. by gravity to the respective rotary disc via e.g. sloped conveyor tracks (so-called chutes). If, in contrast, driven conveyor belts are provided, these guarantee an active transport of the coins to the respective rotary disc, for example if suitably tilted conveyor tracks are not possible due to the installation space. In the case of several openings, several conveyor tracks or respectively conveyor belts can be provided accordingly. In the case of several openings, the conveyor tracks or respectively the conveyor belts can connect respectively one opening with one coin return or respectively one coin storage unit. Depending on their opening and thus their diameter or respectively their type, the coins are thus fed to one of the rotary discs, which then in turn sort the coins into the corresponding coin returns or respectively coin storage units.

According to a further embodiment, a coin deflector permanently arranged above its surface can be assigned to the at least one additional rotary disc, through which coins located on the at least one additional rotary disc are directed to the at least one coin return and/or the at least one coin storage unit. This enables a particularly easy sorting. The coin deflectors serve as strippers, under which the rotary discs turn through. The coins are then stripped by the for example sickle-shaped coin deflectors from the respective surface of the rotary disc and sorted into the corresponding coin returns or respectively coin storage units. In the case of several additional rotary discs, such a coin deflector is assigned accordingly to each of the different rotary discs. Each of the coin deflectors then feeds the coins into respectively one coin return or respectively one coin storage unit. If one or more of the additional rotary discs are provided for receiving and sorting different coins in different sections, corresponding coin deflectors can be assigned to these different sections for the sorting of different coin types.

According to a further embodiment, the conveying device can comprise a rotatingly driven conveyor belt arranged above the coin conveyor track for conveying the coins along the coin conveyor track. The conveyor belt can run in sections above the rotary disc. The guide edge of the coin conveyor track can have a spiral progression such that it approaches the conveyor belt in the conveying direction of the coins. The coin conveyor track and the conveyor belt can run eccentrically to the rotary disc. The coin conveyor track and the conveyor belt can thereby have a larger diameter than the rotary disc.

The coins are captured by the conveyor belt and conveyed further through the coin discharge area along the coin conveyor track. The conveyor belt consists of a material with high friction, e.g. caoutchouc, TPU, PU, rubber, etc. and has for example continuous lamellas, which can stand perpendicular or at an angle between 0° and 90° with respect to a carrier belt for the lamellas. The elastic lamellas ensure that coins with different diameters and different thicknesses can be securely conveyed by the conveyor belt. The conveyor belt also ensures that the coins are separated and thus conveyed in succession along the coin conveyor track. Through a spiral progression of the guide edge of the coin conveyor track, a particularly compact structure of the coin sorting device is achieved with simultaneously secure guiding of the coins along the coin conveyor track.

BRIEF DESCRIPTION OF THE SEVERAL VIEWS OF THE DRAWINGS

One exemplary embodiment of the invention is explained below using figures. They show in a very schematic manner.

DETAILED DESCRIPTION OF THE INVENTION

Figure 1:
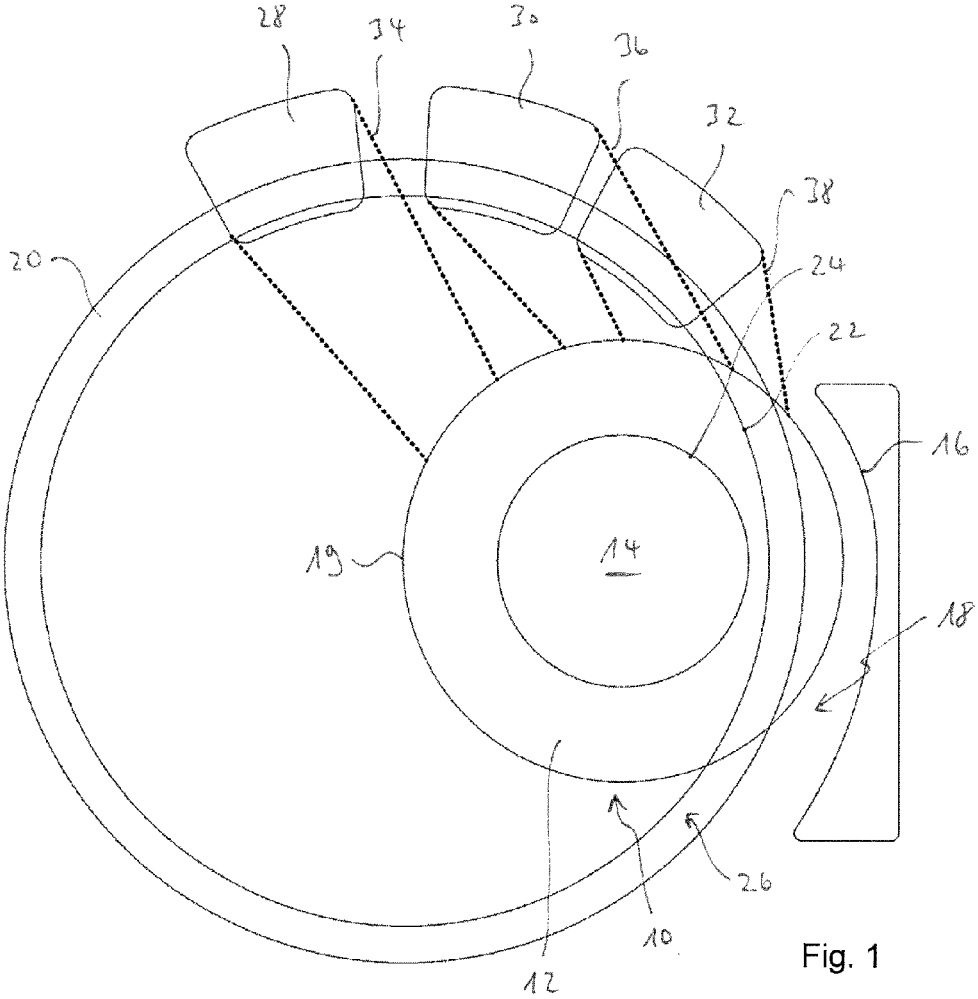
FIG. 1 a coin sorting device according to the invention in a partially transparent section-wise view from the top, FIG. 2 a section-wise cross-section of the coin sorting device from FIG. 1 and FIG. 3 a partially transparent (for illustrative purposes) view of a part of the coin sorting device from FIGS. 1 and 2 from the top.

While this invention may be embodied in many different forms, there are described in detail herein a specific preferred embodiment of the invention. This description is an exemplification of the principles of the invention and is not intended to limit the invention to the particular embodiment illustrated.

If not otherwise specified, the same reference numbers indicate the same objects in the figures. The coin sorting device according to the invention has a housing not shown in the figures with a coin inlet area, for example in the form of an intake hopper (also not shown). Moreover, a first rotary disc 10 rotatingly drivable by means of a rotary drive (not shown) for receiving a plurality of coins to be sorted with different diameters is arranged in the housing. The rotary disc 10 has an annular disc area 12 and a circular middle part 14 delimited by the disc area 12 and elevated relative to the bottom of the disc area 12. The middle part 14 can also be rotatingly drivable or fixed. In the example shown, the rotary disc 10 is rotatingly driven clockwise. Reference number 16 shows a wall section that forms a boundary of a coin discharge area 18. On the side opposite the coin discharge area 18, the rotary disc 10 is surrounded in sections by a guide wall 19. Through the rotary disc 10 working as a centrifuge, conveyed coins make their way under a conveyor belt shown with reference number 20 of a conveying device. In particular, the coins are pushed by the rotary disc 10 on one hand against the inner flank 22 of the conveyor belt 20 and on the other hand against the opposite-lying edge 24 of the middle part 14. The flank 22 and the edge 24 form a wedge-shaped inlet of the coin discharge area 18. The coins are thereby captured by lamellas provided on the bottom side of the conveyor belt 20 and taken along into the coin discharge area 18. It can be seen in the figure that the conveyor belt 20 progresses in sections above the rotary disc 10.

An also circular coin conveyor track 26 for the coins runs below the conveyor belt 20 rotatingly driven along a circular path. The coin conveyor track 26 is delimited by a guide edge not shown in FIG. 1 on its inside or on its outside, along which the coins are conveyed by the conveyor belt 20 along the coin conveyor track 26. A generally known coin check area (not shown) can be provided along the coin conveyor track 26, in which conveyed coins are checked with respect to their diameter and/or their type or respectively value or with respect to their authenticity. Furthermore, a coin sorting area is provided along the coin conveyor track in an also generally known manner. In the example shown in FIG. 1, the coin sorting area comprises several openings in the form of sorting holes, three of which are shown with reference numbers 28, 30, 32 in FIG. 1. Flaps can also be assigned to each of the sorting holes 28, 30, 32, which are opened depending on a measurement result from suitable sensors of the coin check area such that coins of one diameter or respectively one type are fed to each sorting hole 28, 30, 32. The coins can then fall downwards for example due to gravity through the sorting holes 28, 30, 32. But it is also possible that the sorting holes 28, 30, 32 are always open and become larger in the conveying direction of the coins, i.e. clockwise in FIG. 1, along the coin conveyor track 26 such that a generally known passive sorting of the coins into the sorting holes 28, 30, 32 takes place. It can also be seen in FIG. 1 that the coin conveyor track 26 and the conveyor belt 20 have a greater diameter than the rotary disc 10 and are arranged eccentrically to the rotary disc 10. The guide edge of the coin conveyor track 26 can have a spiral progression such that it approaches the conveyor belt in the conveying direction of the coins.

Reference numbers 34, 36 and 38 in FIG. 1 indicate with dotted lines sorting paths for coins that have fallen through the individual sorting holes 28, 30, 32. These sorting paths 34, 36, 38 can be for example guideways (chutes) tilted with respect to the horizontal, along which the coins that have fallen through the sorting holes 28, 30, 32 are guided by gravity.

Figure 2:
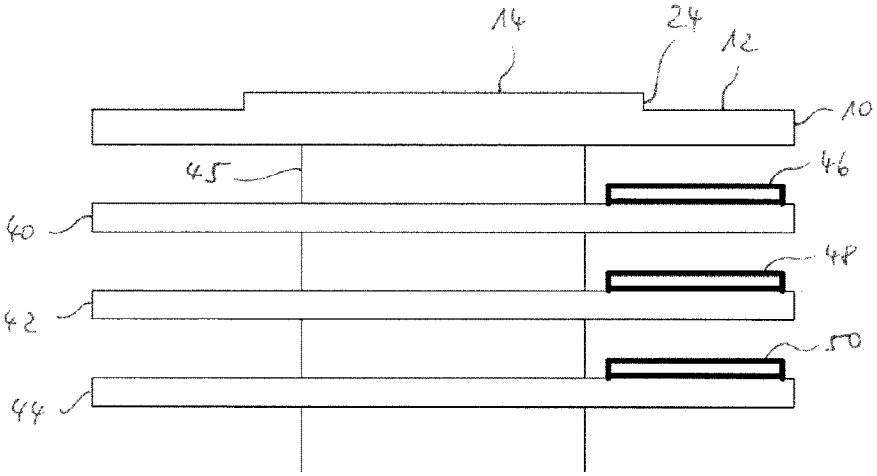
Figure 3:
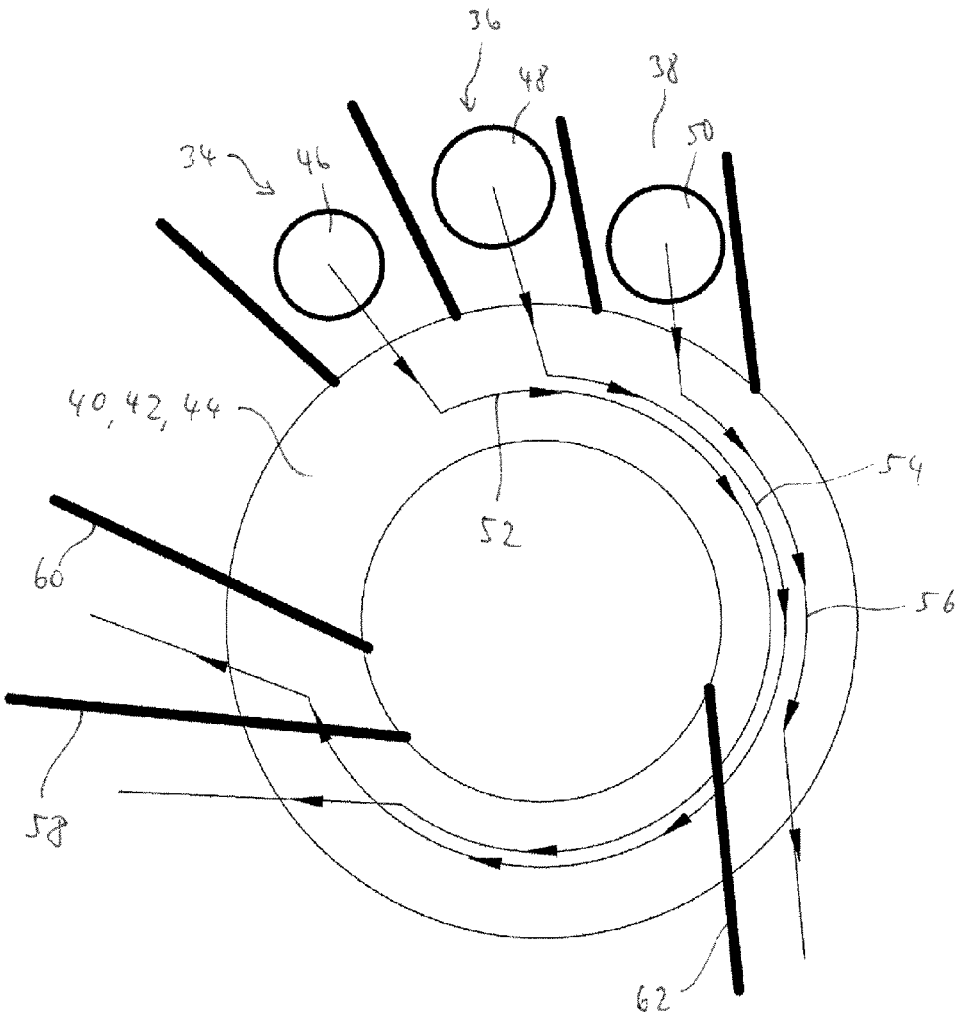

The sorting of the coins shall be explained in greater detail based on FIGS. 2 and 3. FIG. 2 shows on one hand the first rotary disc 10 shown in FIG. 1 with its annular disc area 12 and the elevated middle part 14. Moreover, it can be seen in the example shown that three additional rotary discs 40, 42, 44 also rotatingly drivable by means of a suitable rotary drive are arranged in three planes arranged below the first rotary disc 10. The additional rotary discs 40, 42, 44 each also have an annular disc surface. The annular disc surfaces are bordered in the shown example by a central support 45. A drive shaft of a rotary drive can be integrated into the support 45. The guideways 34, 36, 38 shown in FIG. 1 each end on one of the additional rotary discs 40, 42, 44 and feed coins that have fallen through the sorting holes 28, 30, 32 accordingly to the additional rotary discs 40, 42, 44. Such coins are shown schematically in FIG. 2 with reference numbers 46, 48, 50. FIG. 3 shows a partially transparent view of the coin sorting device according to the invention from the FIGS. 1 and 2. A view from the top is thereby shown, wherein the first rotary disc 10 is not shown. For illustrative purposes, the additional rotary discs 40, 42, 44 are shown transparently in FIG. 3. Naturally, the coins 46, 48, 50 are not conveyed on the same of the additional rotary discs 40, 42, 44 but rather each on one of the additional rotary discs 40, 42, 44 arranged on top of each other, as can be seen in FIG. 2. FIG. 3 also shows schematically the guideways 34, 36, 38, from which the coins 46, 48, 50 make their way to the additional rotary disc 40, 42, 44 assigned to them. The first coin 46 that passed through the first sorting hole 28 and over the guideway 34 is then conveyed on the additional rotary disc 40 assigned to it along the conveying path shown in FIG. 3 with reference number 52. The second coin 48 that passed through the second sorting hole 30 and over the second guideway 36 is then conveyed on the additional rotary disc 42 assigned to it along the second conveying path shown in FIG. 3 with reference number 54. The third coin 50 that passed through the third sorting hole 32 and over the third guideway 38 is then conveyed on the additional rotary disc 44 assigned to it along the third conveying path shown in FIG. 3 with reference number 56.

A coin deflector permanently arranged mainly directly above their surface is assigned to each of the additional rotary discs 40, 42, 44. The coin deflector assigned to the first additional rotary disc 40 is shown in FIG. 3 with reference number 58. The coin deflector assigned to the second additional rotary disc 42 is shown in FIG. 3 with reference number 60. The coin deflector assigned to the third additional rotary disc 44 is shown in FIG. 3 with reference number 62. The coin deflectors 58, 60, 62 are held on the central support 45 in the shown example and each serve as a stripper. They strip the coins 46, 48, 50 from the surface of the respective additional rotary disc 40, 42, 44, in the shown example to one coin storage unit each, for example a coin tube, which is assigned to the respective diameter or respectively coin type. This is shown in FIG. 3 by the conveying paths shown with the reference numbers 52, 54, 56. As indicated before, these coin storage units can be coin tubes, from which coins can then be paid out to a customer in a targeted manner in the case of an additional payment transaction.

The coin sorting device according to the invention permits a reliable and flexible sorting of the coins with a simultaneously compact structure.

This completes the description of the preferred and alternate embodiments of the invention. Those skilled in the art may recognize other equivalents to the specific embodiment described herein which equivalents are intended to be encompassed by the claims attached hereto.

What is claimed is:

1. A coin sorting device, comprising:

a housing and a first rotary disc (10) arranged in the housing and rotatingly drivable by a rotary drive for receiving a plurality of coins to be sorted with different diameters, wherein the first rotary disc (10) is surrounded at least in sections by a guide wall (19) and wherein a coin discharge area (18) delimited by a wall section (16) is provided, through which coins located on the rotatingly driven first rotary disc (10) arrive at a coin conveyor track (26) connecting to the coin discharge area (18), wherein a conveying device is provided for conveying the coins along the coin conveyor track (26), wherein the coin conveyor track (26) is delimited by a guide edge on its inside and/or its outside, along which the coins are conveyed by the conveying device, and wherein at least one opening (28, 30, 32) is provided in and/or next to the coin discharge area (18) and/or along and/or next to the coin discharge track (26), through which the coins can make their way to an area below the first rotary disc (10), wherein in that, in at least one plane below the first rotary disc (10), at least one additional rotary disc (40, 42, 44) rotatingly drivable by means of a rotary drive is arranged, which is designed to convey coins to at least one coin return and/or to at least one coin storage unit, wherein the conveying device comprises a rotatingly driven conveyor belt (20) arranged above the coin conveyor track (26) for conveying the coins along the coin conveyor track (26), and wherein the guide edge of the coin conveyor track (26) has a spiral progression such that it approaches the conveyor belt (20) in the conveying direction of the coins.

2. The coin sorting device according to claim 1, wherein at least one coin check area and at least one coin sorting area are provided in the conveying direction of the coins subsequent to the coin discharge area (18) along the coin conveyor track (26).

3. The coin sorting device according to claim 1, wherein the first rotary disc (10) has a circular middle part (14) delimited by an annular disc area (12) and elevated with respect to the bottom of the annular disc area (12), wherein the middle part (14) is also rotatingly drivable or fixed.

4. The coin sorting device according to claim 1, wherein the at least one opening (28, 30, 32) comprises a hole (28, 30, 32), into which the coins can fall.

5. The coin sorting device according to claim 1, wherein at least one coin deflector (58, 60, 62) is assigned to the at least one additional rotary disc (40, 42, 44), and permanently arranged above the surface of the at least one additional rotary disc (40, 42, 44), wherein coins located on the at least one additional rotary disc (40, 42, 44) are directed to the at least one coin return and/or the at least one coin storage unit through the at least one coin deflector (58, 60, 62).

6. The coin sorting device according to claim 1, wherein the coin conveyor track (26) runs eccentrically to the rotary disc (10).

7. The coin sorting device according to claim 1, wherein the coin conveyor track (26) has a larger diameter than the rotary disc (10).

8. The coin sorting device according to claim 1, wherein the conveyor belt (20) runs in sections above the rotary disc (10).

9. The coin sorting device according to claim 1, wherein a conveying device is provided, which is designed to guide coins that have passed through the at least one opening (28, 30, 32) to the at least one additional rotary disc (40, 42, 44).

10. The coin sorting device according to claim 9, wherein the conveying device comprises one or more conveyor tracks (34, 36, 38) for the coins.

11. The coin sorting device according to claim 9, wherein the conveying device comprises one or more conveyor belts for the coins.

12. The coin sorting device according to claim 1, wherein several openings (28, 30, 32) are provided, wherein the openings (28, 30, 32) are each provided for coins of different diameters and/or different types.

13. The coin sorting device according to claim 12, wherein the several openings (28, 30, 32) are arranged behind each other in the conveying direction of the coins along the coin conveyor track (26).

14. The coin sorting device according to claim 12, wherein the openings (28, 30, 32) have different sizes.

15. The coin sorting device according to claim 12, wherein at least one sensor device is provided, by means of which the diameter and/or the type of the coins can be determined, and that at least one actuating device is provided, with which the coins can be directed into one of the openings (28, 30, 32) depending on their diameter and/or their type.

16. The coin sorting device according to claim 15, wherein the at least one opening (28, 30, 32) is closed in the idle state by a flap, wherein the actuating device is designed to move the flaps of the opening (28, 30, 32) in a targeted manner into an open state in order to thus direct the coins into one of the openings (28, 30, 32) depending on their diameter and/or their type.

17. The coin sorting device according to claim 15, wherein the actuating device comprises an actuating element, through the actuation of which coins can be directed into one of the openings (28, 30, 32) depending on their diameter and/or their type.

18. The coin sorting device according to claim 12, wherein several additional rotary discs (40, 42, 44) rotatingly drivable by means of a rotary drive are arranged in different planes below the first rotary disc (10), wherein the additional rotary discs (40, 42, 44) are designed to convey the coins to different coin returns and/or different coin storage units, and wherein the conveying device is designed to guide the coins to one of the additional rotary discs (40, 42, 44) depending on the opening (28, 30, 32), through which it passes.

* * * * *